US011577267B1

(12) United States Patent
Pitt

(10) Patent No.: US 11,577,267 B1
(45) Date of Patent: Feb. 14, 2023

(54) SPRINKLER

(71) Applicant: Jess Harding Pitt, Klamath Falls, OR (US)

(72) Inventor: Jess Harding Pitt, Klamath Falls, OR (US)

( * ) Notice: Subject to any disclaimer, the term of this patent is extended or adjusted under 35 U.S.C. 154(b) by 0 days.

(21) Appl. No.: 17/367,023

(22) Filed: Jul. 2, 2021

(51) Int. Cl.
*B05B 15/625* (2018.01)

(52) U.S. Cl.
CPC ..... *B05B 15/625* (2018.02)

(58) Field of Classification Search
CPC ..... B05B 15/625; B05B 15/62; B05B 15/60; A62C 31/28; A62C 3/0292; A62C 31/02; A62C 31/03; A62C 31/05; A62C 31/07
USPC ..... 248/83, 80, 536, 148; 239/279, 280, 239/280.5
See application file for complete search history.

(56) References Cited

U.S. PATENT DOCUMENTS 2,439,062 A * 4/1948 Shur ..... E04H 12/32 248/536
2,845,243 A * 7/1958 Mowers ..... H01Q 1/1221 248/539
3,058,542 A * 10/1962 Rogalla ..... E06C 1/39 182/155
5,193,773 A * 3/1993 Middleton ..... E04D 15/00 248/148
5,249,397 A * 10/1993 Monaco ..... E04G 3/265 52/126.1
6,824,073 B1 * 11/2004 Haney ..... B05B 15/62 239/281
7,673,696 B1 * 3/2010 Gunn ..... A62C 3/00 169/48
7,874,451 B2 * 1/2011 Bel ..... E04D 15/00 220/628
9,308,405 B2 * 4/2016 Kameishi ..... A62C 37/12
9,332,696 B2 * 5/2016 Salsberg ..... A01G 25/167
D762,817 S * 8/2016 Salsberg ..... D23/216
9,999,894 B2 * 6/2018 Becktell ..... B05B 15/625
10,449,401 B2 * 10/2019 Coffey ..... B05B 15/62
2009/0200044 A1 * 8/2009 Durkin ..... B05B 15/62 169/54
2009/0223741 A1 * 9/2009 Picard, Jr. ..... E04G 21/3223 248/168
2016/0263609 A1 * 9/2016 Holmes ..... B05B 15/65
2019/0134658 A1 * 5/2019 Celia ..... B05B 15/622

* cited by examiner

*Primary Examiner* — Ingrid M Weinhold
(74) *Attorney, Agent, or Firm* — Plager Schack LLP; Mark H. Plager; Kara Verryt

(57) ABSTRACT

A sprinkler configured to shoot a liquid, such as water or a mixture of water and a gel, may include a chasse, which may be an elongate and substantially hollow center beam with a first closed end and a second open end; a plurality of adjustable legs extending from each of the first closed end and the second end; a top post extending upward from a central portion of the chasse; a sprinkler head operatively attached to the top post; and an end post extending from the second open end, wherein the end post is configured to operatively attach to a liquid source. The angle at which each leg extends from the chasse may be independently adjustable to accommodate various terrains and sloped surfaces without impeding functionality of the sprinkler.

4 Claims, 4 Drawing Sheets

SPRINKLER

BACKGROUND

The embodiments described herein relate generally to fire property protection and, more particularly, to a large sprinkler that shoots water and gel to protect property during, for example, a wildfire.

When it comes to protecting property, and particularly personal property, from a wildfire, there are no sufficient systems. Conventional sprinklers use a large volume of water, require a high-pressure pump, and cannot be set up on uneven terrain or rooftops. There are no high-powered portable sprinkler bases that can be pre-staged to be used at the last minute to save water waste or that can be set up in minutes.

Therefore, what is needed is a high-powered sprinkler that is portable, easy to set up, and does not require a high-pressure pump, while simultaneously being able to be used on uneven terrain.

SUMMARY

Some embodiments of the present disclosure include a sprinkler configured to shoot a liquid, such as water or a mixture of water and a gel. The sprinkler may include a chasse, which may be an elongate and substantially hollow center beam with a first closed end and a second open end; a plurality of adjustable legs extending from each of the first closed end and the second end; a top post extending upward from a central portion of the chasse; a sprinkler head operatively attached to the top post; and an end post extending from the second open end, wherein the end post is configured to operatively attach to a liquid source. The angle at which each leg extends from the chasse may be independently adjustable to accommodate various terrains and sloped surfaces without impeding functionality of the sprinkler.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
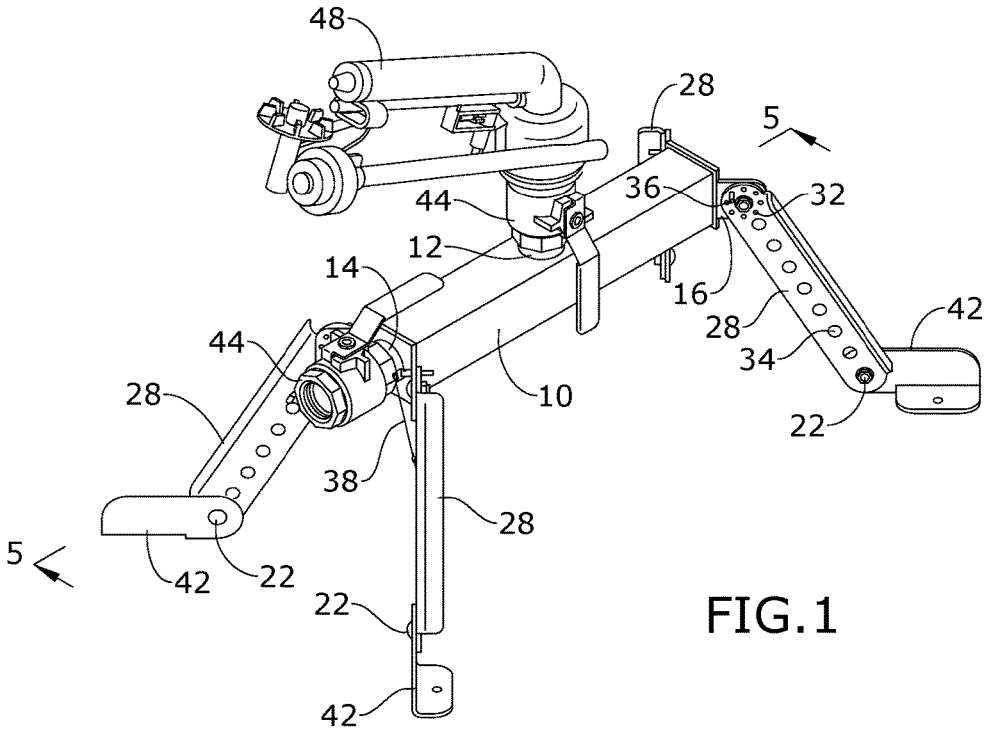
FIG. 1 is a perspective view of one embodiment of the present disclosure.
Figure 2:
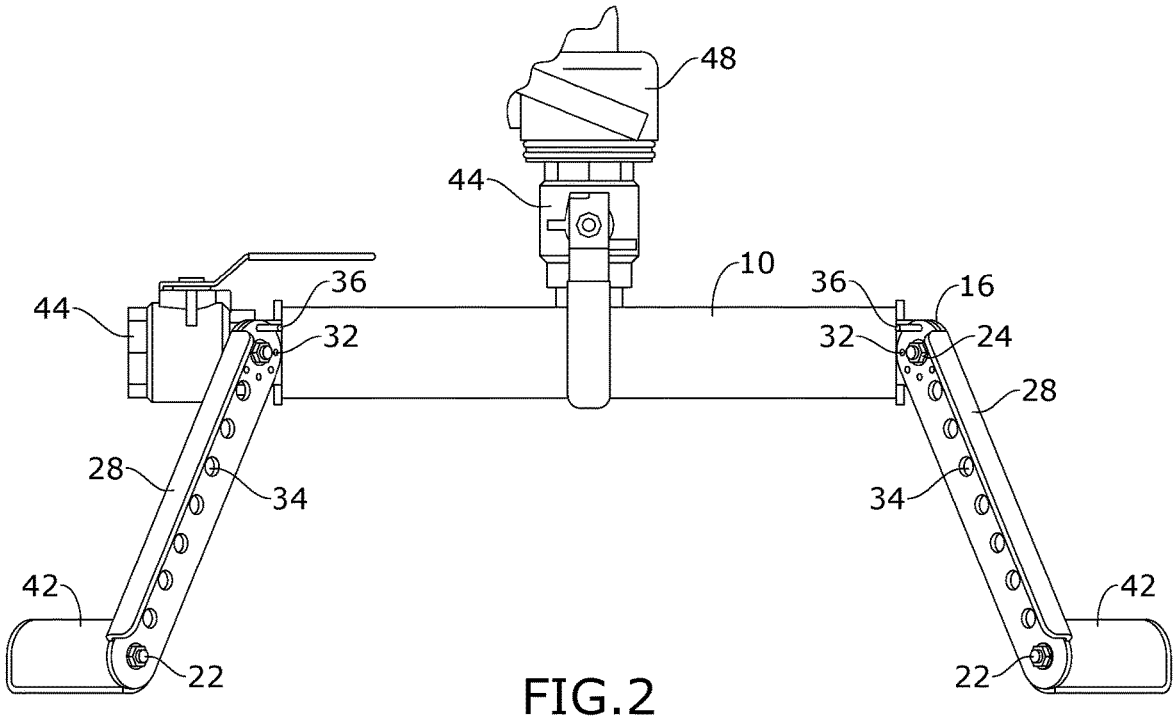
FIG. 2 is a side view of one embodiment of the present disclosure.
Figure 3:
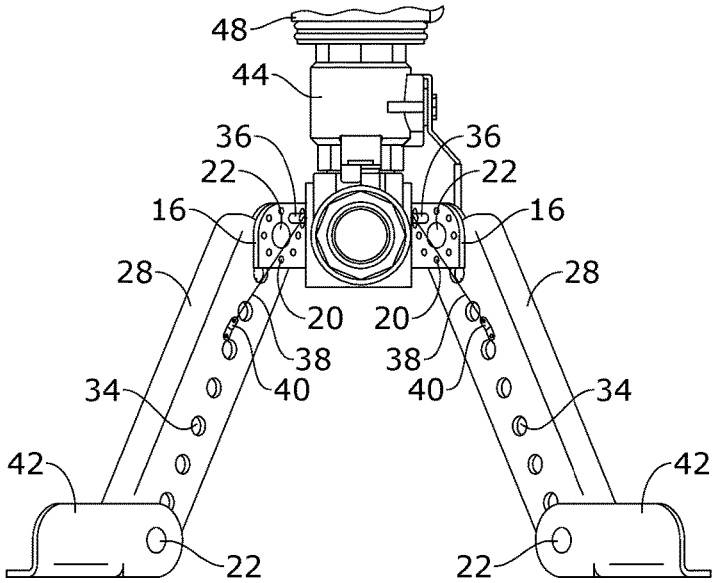
FIG. 3 is a front view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a high-powered portable sprinkler and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-7, some embodiments of the invention include a sprinkler configured to shoot a liquid, such as water or a mixture of water and gel, the sprinkler comprising a chasse 10 comprising an elongate and substantially hollow center beam with a first closed end and a second open end; a plurality of adjustable legs 28 extending from each of the first closed end and the second end; a top post 12 extending upward from a central portion of the chasse 10; a sprinkler head 48, such as a Skipper head, operatively attached to the top post 12; and an end post 14 extending from the second open end, wherein the end post 14 is configured to operatively attach to a water or water/gel mixture source. As shown in the Figures, each of the top post 12 and the end post 14 may be operatively attached to a respective valve 44. For example, each valve 44 may comprise a nipple 46 designed to engage with interior walls of the post 12, 14. The valve 44 may include a handle or other mechanism that can be manipulated to either block flow through the valve 44 or allow for flow through the valve 44, as desired. In a particular embodiment, each of the top post 12 and end post 14 may have threaded inner walls, while the outer walls of each nipple 46 may also be threaded, and the outer threaded walls may be designed to removably engage with the threaded inner walls. In function, the liquid, such as water or a combination of water and gel (i.e., a fire suppressant) may flow from the source, through the end post 14, into the chasse 10, and up and out through the sprinkler head 48 attached to the top post 12.

Figure 4:
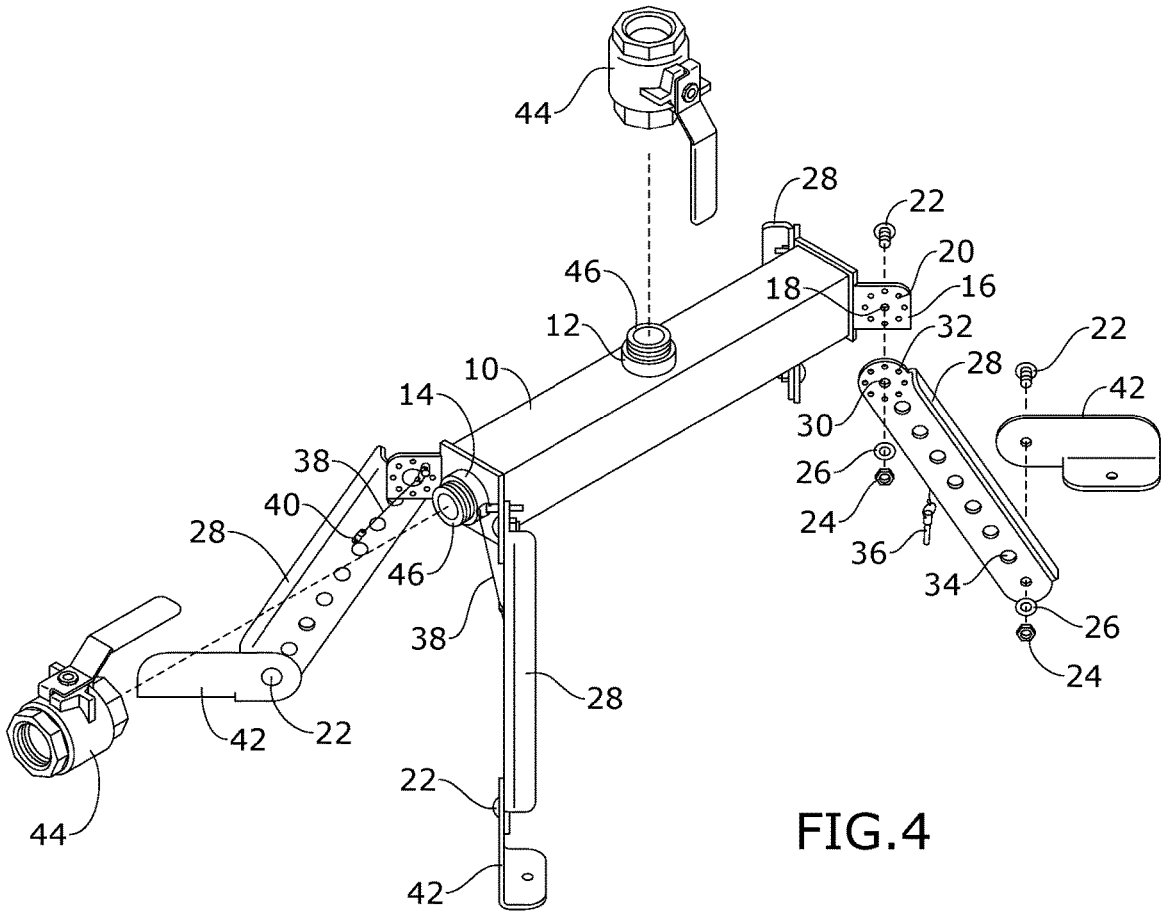
FIG. 4 is a partial exploded view of one embodiment of the present disclosure.
Figure 5:
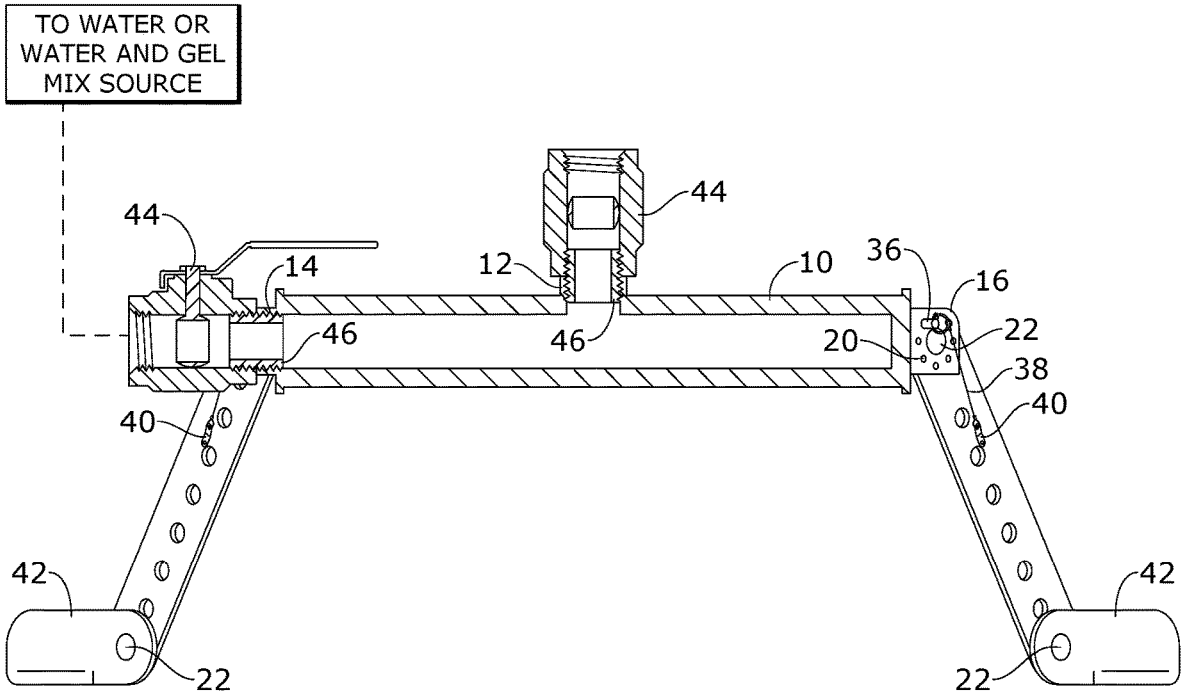
FIG. 5 is a section view of one embodiment of the present disclosure, taken along line 5-5 in FIG. 1.
Figure 6:
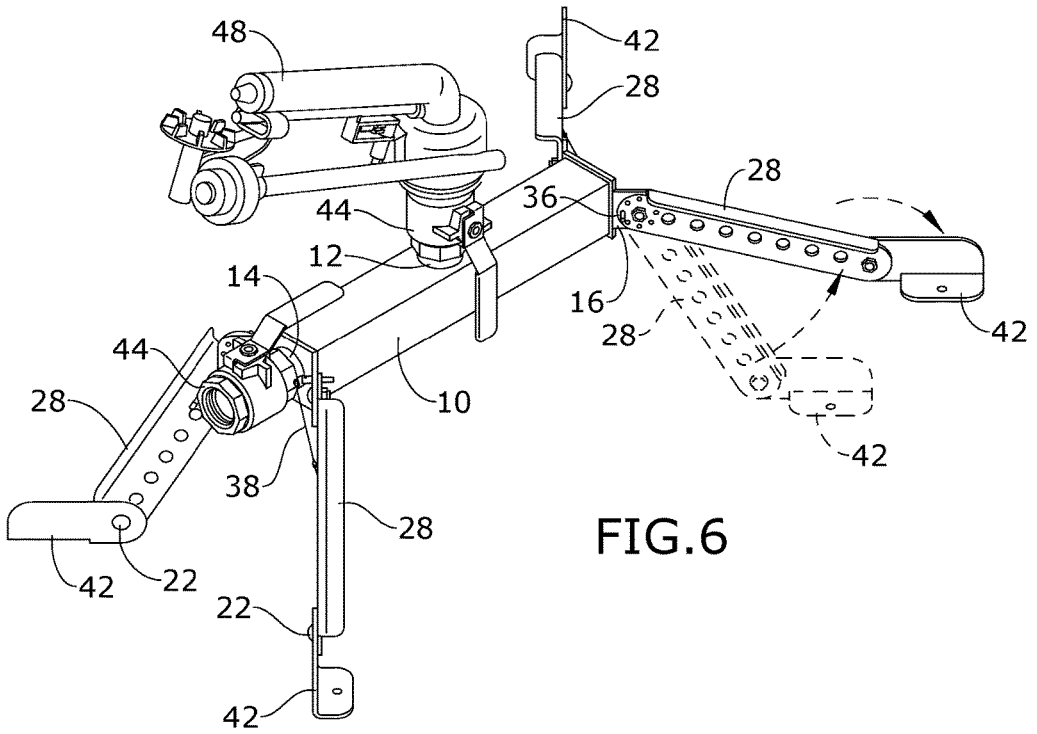
FIG. 6 is a perspective view of one embodiment of the present disclosure.

As shown in the Figures, and as described above, a plurality of adjustable legs 28 may extend from each end of the chasse 10. For example, two adjustable legs 28 may from each end of the chasse 10. As shown in the Figures, each leg 28 may comprise an elongate leg 28, such as an elongate portion with a lip extending perpendicularly outward from a long edge thereof, wherein the elongate portion comprises a plurality of leg orifices 34 extending there through along a length of the elongate portion. Each leg 28 may have a foot 42 attached thereto. For example, a foot 42 may be pivotably attached to an end of the leg 28 distal from the chasse 10. In a particular embodiment, the foot 42 may be pivotably attached to the leg 28 by a bolt 22 extending through an orifice in the foot 42 and a leg orifice 34. More specifically, as shown in FIG. 4, a bolt 22 may extend through the foot 42 and the leg orifice 34 and engage with a washer 26 and a nut 24 to secure the foot 42 to the leg 28. As shown in FIG. 6, the angle of the foot 42 with respect to the leg 28 may vary, depending on the surface on which the sprinkler is placed. As also shown in the figures, the foot 42 may have a substantially L-shaped cross-section, wherein a lip portion is configured to be placed onto the surface, and a wall portion extends substantially perpendicularly from the lip portion and wherein the wall portion is designed to attach to the leg 28.

Figure 7:
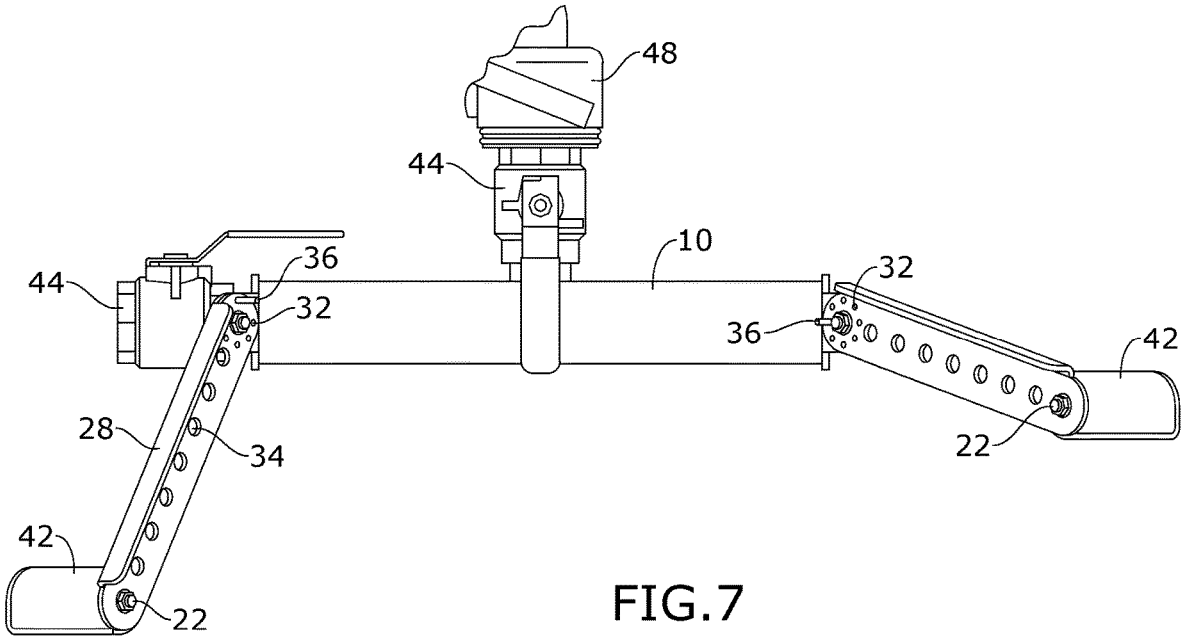
FIG. 7 is a front view of one embodiment of the present disclosure.

As described above, the legs 28 may be attached to the chasse 10. More specifically, the legs 28 may be rotatably attached to the chasse 10 such that the angle at which the legs 28 extend from the chasse 10 may be adjustable, depending on the surface onto which the sprinkler is placed. In embodiments, the legs 28 may each be independently adjustable, such that different legs 28 may extend at different angles, as shown in FIG. 7. In a particular embodiment, an end of the leg 28 proximal to the chasse 10 may comprise a leg bolt hole 30 surrounded by a plurality of leg pinholes 32. For example, the leg pinholes 32 may be evenly spaced in a circle orientation around the leg bolt hole 30. The chasse 10 may have a corner tab 16 extending at an outward angle with respect to an axis of the chasse 10. The corner tab 16 may comprise a corner tab bolt hole 18 surrounded by a plurality of corner tab pinholes 20, wherein the corner tab bolt hole 18 and the corner tab pinholes 20 are designed to align with the leg bolt hole 30 and the leg pinholes 32 when the leg 28 is attached to the chasse 10. In embodiments, the leg 28 may be attached to the corner tab 16 using a bolt 22. For example, the bolt 22 may extend through the corner tab hole 18 and through the leg bolt hole 30 and be secured using a washer 26 and a nut 24.

In some embodiments and as mentioned above, the angle at which the legs 28 extend from the chasse 10 may be adjustable. For example, as shown in the Figures, the leg 28 may be attached to the corner tab 16 and rotated to its desired angle. A pin, such as a clevis pin 36, may be inserted through one of the corner tab pinholes 20 and the aligned leg pinhole 32, securing the leg 28 at the desired angle. In some embodiments, the clevis pin 36 may be attached to a distal end of a lanyard 38, wherein a proximal end of the lanyard 38 may comprise a lanyard tab 40. In embodiments, the lanyard tab 40 may be attached to the leg 28.

To use the sprinkler of the present disclosure, it may be set up at the desired location, wherein each leg 28 may be adjusted to allow the sprinkler to be placed on any surface. The structure of the sprinkler, cause the liquid stream (i.e., water or water and gel mixture) to be split up into smaller water droplets to limit the water needed to do the job. Because of the structure of the device, there is no need for a high-pressure pump and, rather, the sprinkler can operate as low as 25 GRM.

The device of the present disclosure may have any desired dimensions and may be made of any suitable materials. In some embodiments, the device is made of a metal, such as aluminum.

While the sprinkler is described above as being used to help with wildfires, it is not limited to such use. In fact, use of the sprinkler for various purposes, such as for dust abatement, is also envisioned.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A sprinkler configured to shoot a liquid, the sprinkler comprising:
- a chasse comprising:
  - an elongate and substantially hollow center beam with a first closed end and a second open end; and
  - a plurality of corner tabs, each extending at an outward oblique angle with respect to an axis of the chasse, each corner tab comprising a corner tab bolt hole surrounded by a plurality of corner tab pinholes;
- a plurality of adjustable legs comprising a first plurality of adjustable legs and a second plurality of adjustable legs, wherein:
  - the first plurality of adjustable legs extends from the first closed end and the second plurality of adjustable legs extends from the second open end;
  - an angle at which each leg of the plurality of legs extends from the chasse is independently adjustable;
  - each leg of the plurality of legs comprises a leg bolt hole at an end of the leg proximal to the chasse and a plurality of leg pinholes surrounding the leg bolt hole;
- a top post extending upward from a central portion of the chasse;
- a sprinkler head operatively attached to the top post; and
- an end post extending from the second open end, wherein:
- the end post is configured to operatively attach to a liquid source;
- the corner tab bolt hole and the corner tab pinholes of each of the corner tabs are positioned to align with the leg bolt hole and the leg pinholes of a respective leg of the plurality of legs when the respective leg is attached to the chasse; and
- a pin is designed to removably engage with a corner tab pinhole of the plurality of corner tab pinholes of the respective corner tab and an aligned leg pinhole of the plurality of leg pinholes of the respective leg to secure the respective leg at a desired angle.

2. The sprinkler of claim 1, wherein further comprising:
- a first valve attached to the top post, wherein the sprinkler head is attached to the first valve; and
- a second valve attached to the end post, wherein the liquid source is operatively attached to the second valve.

3. The sprinkler of claim 1, wherein each leg of the plurality of legs comprises a foot pivotably attached to an end of the leg distal from the chasse.

4. The sprinkler of claim 3, wherein the foot is pivotably attached to the leg by a bolt extending through an orifice in the foot and a leg orifice and secured using a fastener.

* * * * *